US009230469B2

(12) United States Patent
Lee et al.

(10) Patent No.: US 9,230,469 B2
(45) Date of Patent: Jan. 5, 2016

(54) DISPLAY DEVICE USING PLURAL GAMMA CURVES AND DRIVING METHOD THEREOF

(71) Applicant: Samsung Display Co., Ltd., Yongin (KR)

(72) Inventors: Neung-Beom Lee, Gwangmyeong-si (KR); Jeong-Hyun Kim, Cheonan-si (KR); Won Hee Lee, Bucheon-si (KR); Woo Jung Jung, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 383 days.

(21) Appl. No.: 13/678,009

(22) Filed: Nov. 15, 2012

(65) Prior Publication Data

US 2014/0022225 A1 Jan. 23, 2014

(30) Foreign Application Priority Data

Jul. 23, 2012 (KR) ..... 10-2012-0079974

(51) Int. Cl.
*G09G 3/36* (2006.01)
*G09G 3/20* (2006.01)

(52) U.S. Cl.
CPC ..... *G09G 3/20* (2013.01); *G09G 3/3648* (2013.01); *G09G 3/3614* (2013.01); *G09G 3/3655* (2013.01); *G09G 2300/0443* (2013.01); *G09G 2310/0205* (2013.01); *G09G 2310/0218* (2013.01); *G09G 2310/0251* (2013.01); *G09G 2320/0204* (2013.01); *G09G 2320/0257* (2013.01); *G09G 2320/0673* (2013.01)

(58) Field of Classification Search
CPC ..... G09G 3/3611
USPC ..... 345/100
See application file for complete search history.

(56) References Cited

U.S. PATENT DOCUMENTS

| | | | | |
|---|---|---|---|---|
| 6,411,346 | B1 | 6/2002 | Numano et al. | |
| 6,529,257 | B1 | 3/2003 | Nakano | |
| 7,027,023 | B2 | 4/2006 | Okishiro et al. | |
| 8,144,163 | B2 * | 3/2012 | Moon | 345/589 |
| 2004/0161192 | A1 | 8/2004 | Hamano et al. | |
| 2004/0217935 | A1 * | 11/2004 | Jeon et al. | 345/100 |
| 2006/0176264 | A1 * | 8/2006 | Go | 345/100 |
| 2006/0268021 | A1 * | 11/2006 | Lin et al. | 345/690 |
| 2008/0158203 | A1 | 7/2008 | Irie et al. | |
| 2009/0040161 | A1 | 2/2009 | Baek et al. | |

(Continued)

FOREIGN PATENT DOCUMENTS

| | | |
|---|---|---|
| JP | 05-224628 | 9/1993 |
| KR | 10-2006-0124962 | 12/2006 |

(Continued)

*Primary Examiner* — Roy Rabindranath
(74) *Attorney, Agent, or Firm* — H.C. Park & Associates, PLC

(57) ABSTRACT

A display device and a driving method is disclosed. The driving method includes receiving an image signal for one frame for one pixel, converting the image signal into at least two data voltages according to at least two gamma curves, applying a first gate signal and a second gate signal to a plurality of gate lines respectively connected to a plurality of subpixels included in one pixel during the frame. The method further includes applying the at least two data voltages to the plurality of subpixels during the frame. A gamma curve for the data voltage applied to one subpixel among the plurality of subpixels includes the at least two different gamma curves and is changed with a period of a first time.

21 Claims, 19 Drawing Sheets

(56) References Cited

U.S. PATENT DOCUMENTS

| | | | | |
|---|---|---|---|---|
| 2009/0179906 | A1* | 7/2009 | Moon | 345/531 |
| 2010/0171893 | A1 | 7/2010 | Huang | |
| 2010/0225841 | A1 | 9/2010 | Park et al. | |
| 2010/0245339 | A1 | 9/2010 | Lin | |
| 2011/0019114 | A1 | 1/2011 | Tsubata | |
| 2011/0043498 | A1 | 2/2011 | Tsubata | |
| 2011/0216249 | A1 | 9/2011 | Tsubata | |

FOREIGN PATENT DOCUMENTS

| | | |
|---|---|---|
| KR | 10-2007-0073309 | 7/2007 |
| KR | 10-2008-0001052 | 1/2008 |

* cited by examiner

FIG. 15A

| Panel display time | | 12hr | 24hr | 168hr |
|---|---|---|---|---|
| A ←→ B Swing | SPL 1 | 42 | 56 | 98 |
| | SPL 2 | 39 | 61 | 101 |
| Conventional | SPL 3 | 46 | 72 | 140 |
| | SPL 4 | 44 | 77 | 135 |

DISPLAY DEVICE USING PLURAL GAMMA CURVES AND DRIVING METHOD THEREOF

CROSS REFERENCE TO RELATED APPLICATION

This application claims priority from and the benefit of Korean Patent Application No. 10-2012-0079974, filed on Jul. 23, 2012, which is hereby incorporated by reference for all purposes as if fully set forth herein.

BACKGROUND OF THE INVENTION

1. Field of the Invention

Exemplary embodiments of the present invention relates to a display device and a driving method thereof.

2. Discussion of the Background

A display device such as a liquid crystal display (LCD) and an organic light emitting diode (OLED) display generally includes a display panel including a plurality of pixels, a gray voltage generator generating a gray reference voltage, and a data driver generating a plurality of gray voltages by using the gray reference voltage and applying the gray voltage corresponding to an input image signal among the generated gray voltages as a data signal to a data line. Each of the pixels may include a switching element and a plurality of signal lines.

An LCD may include two display panels having a pixel electrode and an opposing electrode, and a liquid crystal layer interposed between the pixel electrode and the opposing electrode. The liquid crystal layer may have dielectric anisotropy. The pixel electrode may be arranged as a matrix and may be connected to a switching element, such as a thin film transistor (TFT), to sequentially receive, row by row, the data voltage. The opposing electrode may be formed on the surface of the display panel and may receive a common voltage Vcom. The pixel electrode and the opposing electrode may be applied with the voltages to generate an electric field through the liquid crystal layer. The intensity of the electric field and transmittance of light passing through the liquid crystal layer may be controlled, thereby obtaining a desired image. The luminance of the image displayed by the pixel of the display device may be changed according to a difference between the voltage of the pixel electrode and a common voltage Vcom of the opposed electrode.

A polarity of the data voltage applied to the pixel electrode or the common voltage Vcom may be inverted for a predetermined number of frames, and this may be referred to as frame inversion driving. However, a common voltage may be changed by various factors such as a kickback voltage, the applied data voltage, or a capacitance change of a liquid crystal capacitor due to temperature changes, a leakage current of the thin film transistor, or a signal delay. For example, if the same image is displayed for a long time, the charges may gather at one side of the pixel electrode or the opposing electrode and a DC bias may be generated, thereby generating afterimages.

SUMMARY OF THE INVENTION

Exemplary embodiments of the present invention disclose a display device and a method to drive the display device to improve display quality by DC bias generation in the display device.

Additional features of the invention will be set forth in the description which follows, and in part will be apparent from the description, or may be learned by practice of the invention.

Exemplary embodiments of the present invention disclose a method of driving a display device, including receiving an image signal, converting the image signal into at least two data voltages according to at least two different gamma curves, applying, during a frame, a first gate signal to a first gate line among a plurality of gate lines and a second gate signal to a plurality of gate lines respectively connected to a plurality of subpixels in a pixel, and applying the at least two data voltages to the plurality of subpixels during the frame. Gamma curves for the data voltage are applied to one subpixel among the plurality of subpixels comprise the at least two different gamma curves and the gamma curves for the data voltage are changed with a period of a first time.

Exemplary embodiments of the present invention also disclose a display device including a pixel comprising a plurality of subpixels, a gate line group comprising a plurality of gate lines connected to the plurality of subpixels, and a data line connected to the plurality of subpixels. At least two data voltages according to different gamma curves are applied to the plurality of subpixels during a frame, and gamma curves for the data voltage are applied to one subpixel among the plurality of subpixels include the at least two gamma curves and the gamma curves for the data voltage are changed with a period of a first time.

Exemplary embodiments of the present invention also disclose a method of driving a display device comprising a pixel comprising a plurality of subpixels respectively connected to a plurality of gate lines. The method comprises receiving a first frame of an image signal and applying a first gate signal to a first gate line among the plurality of gate lines for a first portion of one horizontal period of the first frame. The first gate line is connected to a first subpixel of the plurality of subpixels. The method further comprises applying a second gate signal to a second gate line among the plurality of gate lines for a second portion of the one horizontal period of the first frame different from the first portion of the one horizontal period, the second gate line being connected to a second subpixel of the plurality of subpixels; applying the second gate signal to a third gate line among the plurality of gate lines for the second portion of the one horizontal period of the first frame, the third gate line being connected to a third subpixel of the plurality of subpixels; applying a first data signal to the first subpixel during the first portion of the one horizontal period of the frame, the first data signal being determined according to a first gamma curve; and applying a second data signal to the second subpixel and the third subpixel during the second portion of the one horizontal period of the frame, the second data signal being determined according to a second gamma curve different from the first gamma curve.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

FIG. 15A is a table of experimental data corresponding to an afterimage degree of a display device according to exemplary embodiments of the present invention.

DETAILED DESCRIPTION OF THE ILLUSTRATED EMBODIMENTS

Figure 1:
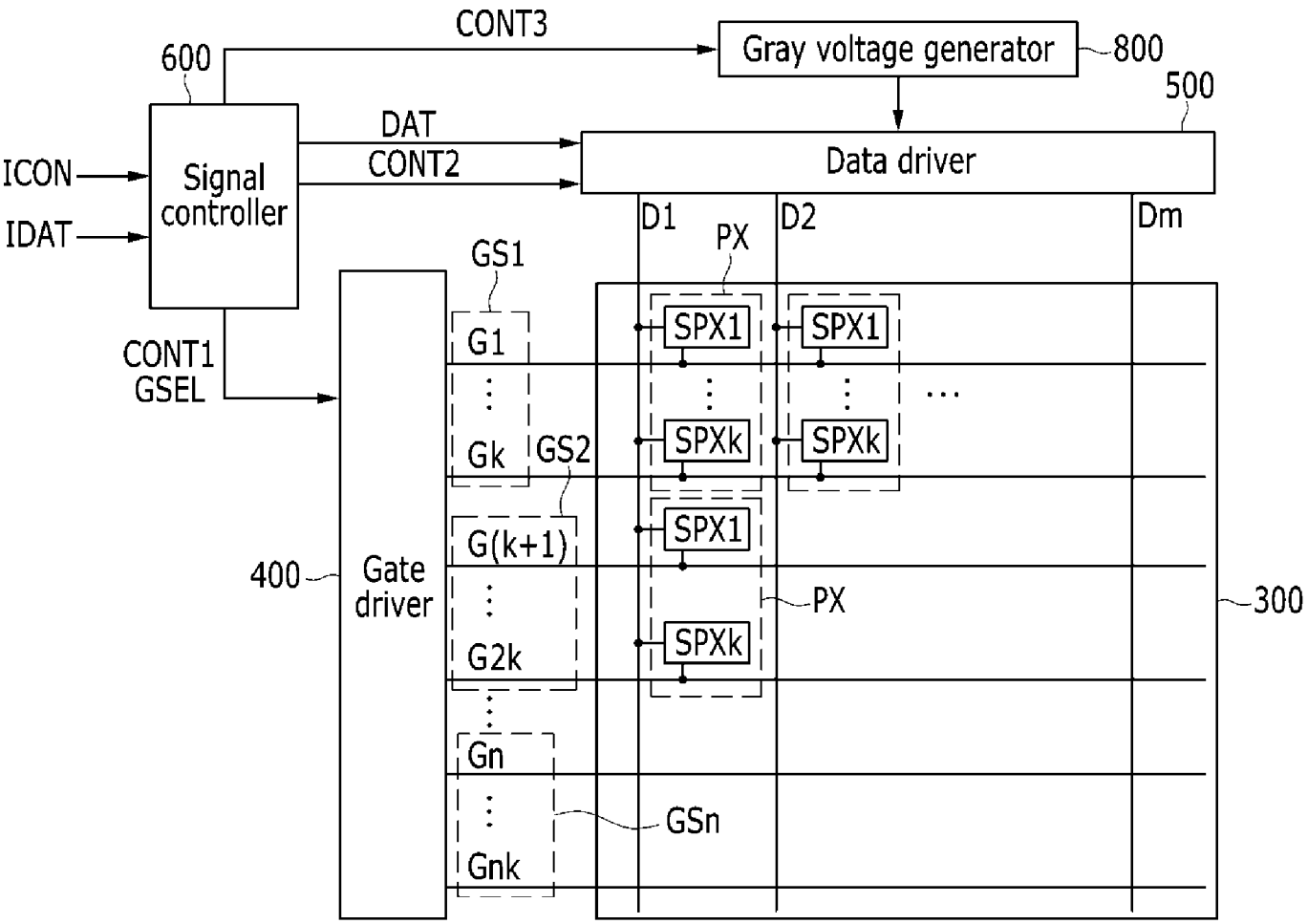
FIG. 1 is a block diagram of a display device according to exemplary embodiments of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element referred to as being "directly on" or "directly connected to" another element or layer, there are no intervening elements or layers present. It may also be understood that for the purposes of this disclosure, "at least one of X, Y, and Z can be construed as X only, Y only, Z only or any combination of two or more items X, Y, and Z (e.g., XYZ, XYY, YZ, ZZ).

FIG. 1 is a block diagram of a display device.

As shown in FIG. 1, a display device may include a display panel 300, a gate driver 400 and a data driver 500 connected thereto, a gray voltage generator 800 connected to the data driver 500, and a signal controller 600. The signal controller 600 may control the gate driver 400, the data driver 500, and the gray voltage generator 800.

The display panel 300 may include a plurality of signal lines G1 to Gn and D1 to Dm (where n and m are any whole numbers greater than 1), and a plurality of pixels PX connected to the plurality of signal lines G1 to Gn and D1 to Dm. The pixels PX may be arranged substantially in a matrix. If the display device is a liquid crystal display, the display panel 300 may include a lower panel 100 and an upper panel 200 that face each other, and a liquid crystal layer 3 that may be interposed between the panels 100 and 200.

The signal lines may include a plurality of gate lines G1 to Gnk that transmit gate signals ("scanning signals") and data lines D1 to Dm that transmit data signals.

The gate lines G1-Gnk may include n (where n is any natural number greater than zero) gate line groups GS1-GSn, and each gate line group GS1-GSn may include k (where k is a natural number at least 2 or greater) gate lines G1-Gnk. The gate lines G1-Gnk may extend in an approximate row direction and may be approximately parallel to each other.

The data lines D1-Dm (where m is a natural number equal to or greater than 1) may extend in an approximate column direction and may be approximately parallel to each other.

Each pixel PX includes k subpixels SPX1-SPXk.

Each of the subpixels SPX1-SPXk may include a switching element (not shown) connected to the data lines D1-Dm and the gate lines G1-Gnk, and a pixel electrode (not shown) connected to the switching element. The switching element may be controlled according to the gate signal transmitted through the gate lines G1-Gnk thereby transmitting the data voltage through the data lines D1-Dm to the pixel electrode.

The subpixels SPX1-SPXk of each pixel PX may be connected to the gate lines G1-Gnk of one gate line group GS1-GSn. The k subpixels SPX1-SPXk included in one pixel PX may be arranged in the same direction as the direction of the gate lines G1-Gnk. It should be understood that the subpixels SPX1-SPXk can be arranged in various arrangements and are not limited to being arranged in the same direction as the direction of the gate lines G1-Gnk. The subpixels SPX1-SPXk included in one pixel PX may be sequentially connected to the gate lines G1-Gnk of the corresponding gate line group GS1-GSn. For example, the subpixels SPX1-SPXk of the pixel PX positioned at the first row may be sequentially connected to the gate lines G1-Gk of the first gate line group GS1.

The subpixels SPX1-SPXk of each pixel PX may be connected to one of the data lines D1-Dm.

For color display, each pixel PX may uniquely display one of three primary colors (i.e., spatial division) or each pixel PX may sequentially display the three primary colors in turn (i.e., temporal division), such that a spatial or temporal sum of the primary colors may be recognized as a desired color. An example of a set of the three primary colors may include red, green, and blue.

The gray voltage generator 800 may generate all gray voltages or a limited number of gray voltages ("reference gray voltages") related to transmittance of the pixels PX.

The reference gray voltage may be positive or negative with respect to the common voltage Vcom. The gray voltage generator 800 may receive gamma data from the signal controller 600 to generate the reference gray voltages based on the gamma data. The gamma data may include gamma data for two different gamma curves. The gamma curve is a curved line of a luminance or a transmittance for the gray level of an input image signal IDAT. A gray voltage or a reference gray voltage may be determined based on the gamma curve. A gamma curve may be a positive gray voltage curved line and a negative gray voltage curved line.

The gate driver 400 may be connected to the gate lines G1-Gnk and may apply a gate signal, which is a combination of a gate-on voltage Von and a gate-off voltage Voff, to the gate lines G1-Gnk.

The data driver 500 may be connected to data lines D1-Dm, and may apply a gray voltage selected from the gray voltage generator 800 to the pixel as a data voltage. When the gray voltage generator 800 does not supply all voltages for all grays and supplies only a predetermined number of the reference gray voltages, the data driver 500 may divide the reference gray voltages to generate gray voltages for all grays and may select a data signal from among the divided gray voltages.

The signal controller 600 may control operations of the gate driver 400, the data driver 500, and the gray voltage generator 800.

Next, the display operation of the display device will be described.

The signal controller 600 may receive the input image signal IDAT and an input control signal ICON as control signals. The input image signal IDAT may have luminance information of each pixel PX, and the luminance may have a predetermined number of grays, for is example $1024=2^{10}$, $256=2^{8}$, or $64=2^{6}$. Examples of the input control signal ICON include a vertical synchronization signal, a horizontal synchronizing signal, a main clock signal, and a data enable signal.

The signal controller 600 may process the input image signal IDAT and the input control signal ICON to output an image signal DAT, and may generate a gate control signal CONT1, a data control signal CONT2, and a gamma control signal CONT3. The signal controller 600 may provide the gate control signal CONT1 to the gate driver 400, the data control signal CONT2 and the output image signal DAT to the data driver 500, and the gamma control signal CONT3 to the gray voltage generator 800.

The gate control signal CONT1 may include a scanning start signal STV instructing a scan start and at least one gate clock signal CPV controlling output timing of the gate-on pulse. The gate control signal CONT1 may also include an output enable signal OE limiting a maintaining time of the gate-on voltage Von. A period of a pulse of at least one gate clock signal CPV may be 1 horizontal period 1H, however the period may not be limited thereto, and may be about ½H.

The signal controller 600 may further generate a gate line selection signal GSEL to output to the gate driver 400. The gate line selection signal GSEL may include information for selecting at least one of the gate lines G1-Gnk of one gate line group GS1-GSn. The gate lines G1-Gnk selected according to the gate line selection signal GSEL may be applied with a gate signal in a waveform that may be different from the other gate lines G1-Gnk. The gate line selection signal GSEL may be generated in a switching circuit included in the signal controller 600 or a selection circuit (multiplexer) of a plurality of bits that may be more than 2 bits.

The gamma control signal CONT3 may include gamma data and a gamma is switching signal CSW. The gamma switching signal CSW may control the gray voltage generator 800 to select a gamma curve by switching between two or more gamma curves included in the gamma data.

The gray voltage generator 800 may generate gray voltage and a limited number of reference gray voltages of a limited number based on the gamma data included in the gamma control signal CONT3. Gray voltage may be provided for different gamma curves and the reference gray voltages may be provided to the data driver 500. The gray voltage generated for each gamma curve may be selected according to the gamma switching signal CSW and output to the data driver 500.

The data driver 500 may receive a data control signal CONT2 and an output image signal DAT from the signal controller 600 to provide data voltage Vd to one row of the pixels PX. The data driver 500 may select the gray voltage corresponding to each output image signal DAT from the gray voltage input from the gray voltage generator 800 to convert the output image signal DAT to an analog data voltage Vd, and may apply the analog data voltage Vd to the corresponding data lines D1-Dm. The gray voltage input from the gray voltage generator 800 may depend on at least two gamma curves that may be switched according to the gamma switching signal CSW. Accordingly, the data voltage Vd applied to the data lines D1-Dm may have a voltage level based on the different gamma curves according to a predetermined period.

When the data driver 500 receives the reference gray voltage from the gray voltage generator 800, the data driver 500 may generate the gray voltage for the entire grays based on the reference gray voltage.

The gate driver 400 may apply the gate-on voltage Von to the gate lines G1-Gnk according to the gate control signal CONT1 transmitted from the signal controller 600 to turn on the switching elements connected to the gate lines G1-Gnk. The data voltages applied to the data lines D1-Dm may be applied to corresponding pixels PX through the turned-on switching elements. At this time, the gate signal applied to the gate lines G1-Gnk included in one gate line group GS1-GSn may include the first gate signal and the second gate signal having different waveforms. The selection of the first and second gate signals may be controlled by the gate line selection signal GSEL.

If data voltage Vd is applied to the pixel PX, the pixel PX may display the luminance corresponding to the data voltage through various optical conversion elements. In a case of the liquid crystal display, a difference between the data voltage Vd applied to the pixel PX and a common voltage Vcom may be represented as a charge voltage of the liquid crystal capacitor, for example, a pixel voltage. Orientations of liquid crystal molecules may vary depending on the magnitude of the pixel voltage, and as a result, polarization of light passing through the liquid crystal layer may vary. The polarization variation is shown as a variation of transmittance of light by a polarizer attached to the liquid crystal display, and as a result, the pixel may display luminance of a gray of an image signal.

By repeatedly performing the above-noted process in one horizontal period units (also referred to as "1H" which is the same as one period of the horizontal synchronization signal Hsync and the data enable signal DE), the gate-on voltage Von may be sequentially applied to all the gate lines G1-Gnk, and the data voltage Vd may be applied to all the pixels PX to display an image of a frame.

When one frame ends and a subsequent frame starts, an inversion signal RVS applied to the data driver 500 may be controlled so that the polarity of the data voltage applied to each pixel PX may be opposite to that in the previous frame ("frame inversion"). In this case, even within one frame, the polarity of the data voltage that flows through one data line may be changed according to a characteristic of the inversion signal or even the polarities of the data voltages applied to one pixel row may be different from each other.

Accordingly, an image displayed by the subpixels SPX1-SPXk included in one pixel PX during one frame may include images according to different gamma curves. The gamma curves for the images displayed in the subpixel SPX1-SPXk in one frame may be changed with the period of a predetermined time (T). For example, the predetermined time (T) may include a plurality of frames.

A structure of one pixel PX of a display device will be described with reference to FIG. 1, FIG. 2 and FIG. 3.

Figure 2:
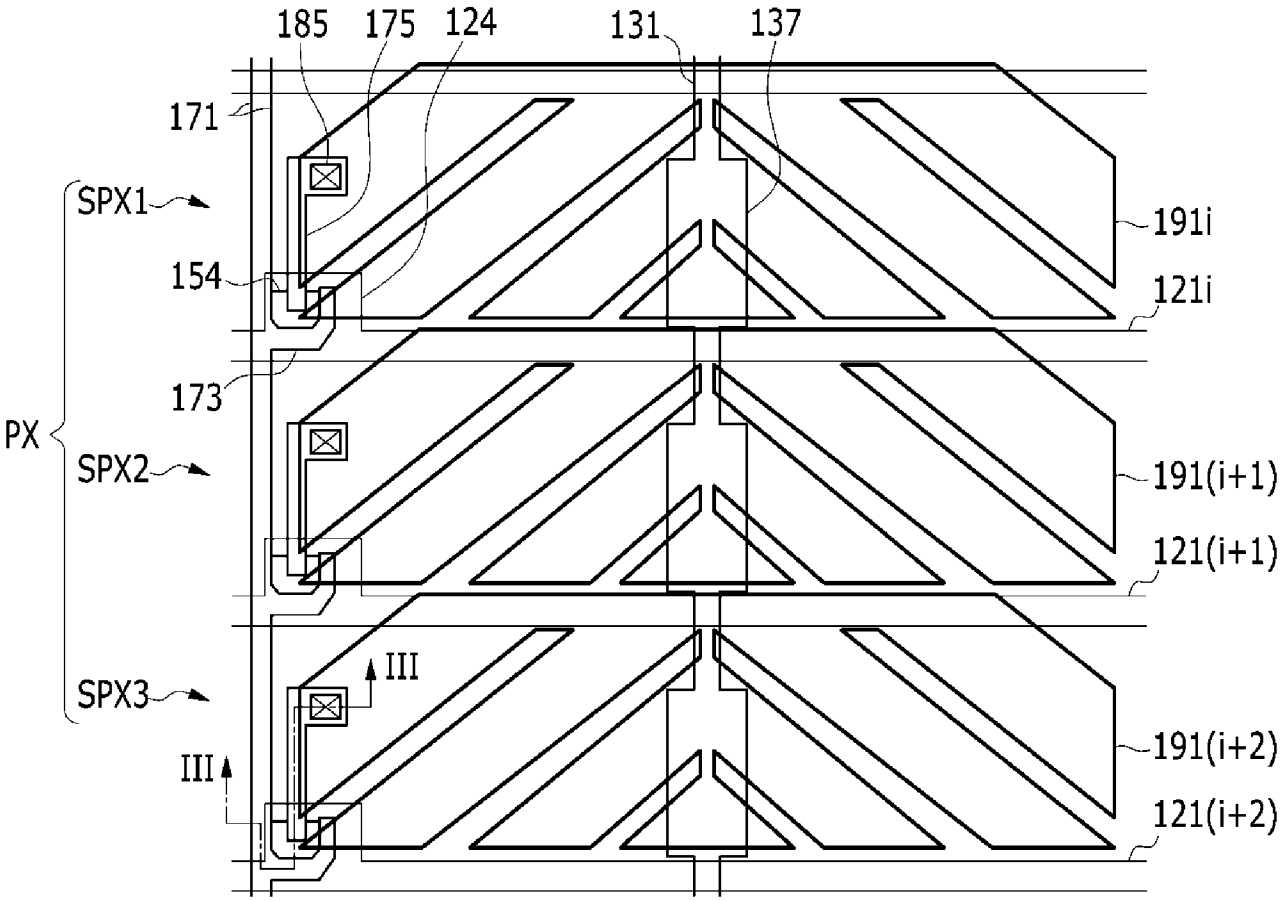
FIG. 2 is a layout view of one pixel of a display device according to exemplary embodiments of the present invention.
Figure 3:
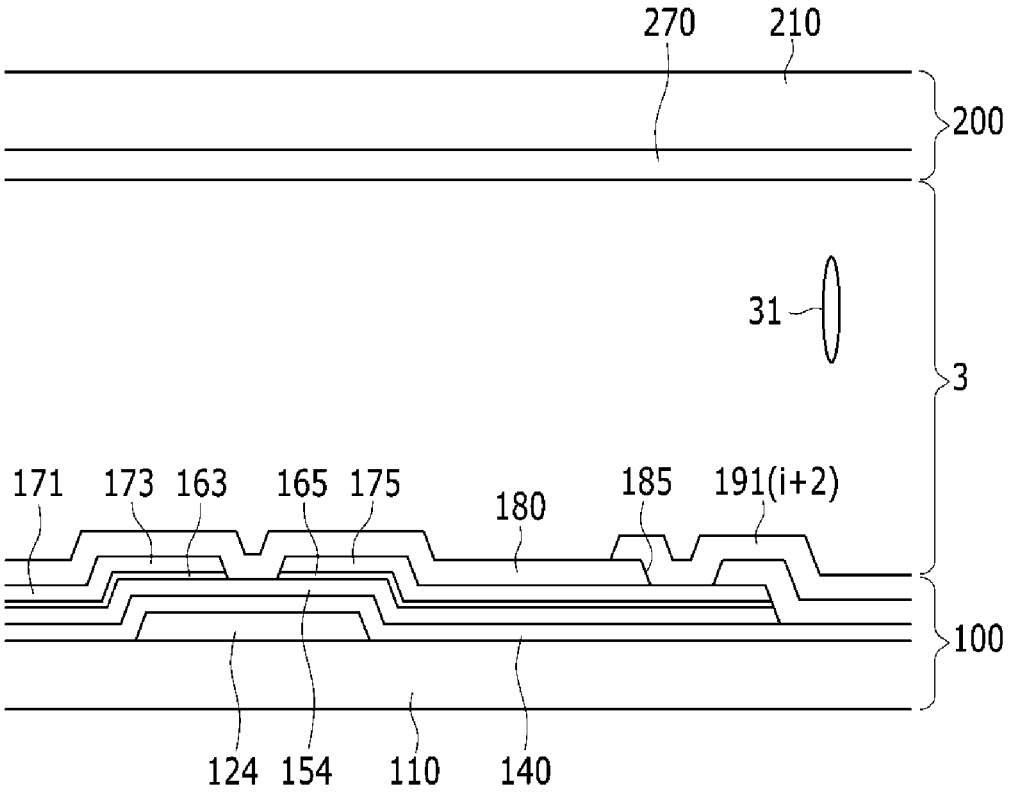
FIG. 3 is a cross-sectional view of the display device of FIG. 2 taken along line III-III in FIG. 2.

FIG. 2 is a layout view of one pixel PX of a display device, and FIG. 3 is a cross-sectional view of the display device taken along the line III-III of FIG. 2.

Referring to FIG. 2 and FIG. 3, a display device such as a liquid crystal display may include a lower panel 100 and an upper panel 200 facing each other, and a liquid crystal layer 3 interposed between the two display panels 100 and 200.

FIG. 2 shows an example in which each pixel PX may include three subpixels SPX1, SPX2, and SPX3 that may be sequentially arranged in a column direction. However, the exemplary embodiments of the present invention may not be limited thereto and a number and/or an arrangement direction of the subpixels included in each pixel PX may be changed.

Referring to the lower panel 100, a plurality of gate conductors including a plurality of gate lines 121*i*, 121(*i*+1), and 121(*i*+2) (where i is any natural whole number greater than 1) and a plurality of storage electrode lines 131 may be formed on an insulation substrate 110, which may be made of a transparent material, such as glass or plastic.

The gate lines 121*i*, 121(*i*+1), and 121(*i*+2) may transmit a gate signal, mainly extend in a row direction, and may be parallel to each other. Each of the gate lines 121*i*, 121(*i*+1), and 121(*i*+2) may be connected to a plurality of gate electrodes 124 corresponding to each of the subpixels SPX1, SPX2, and SPX3.

FIG. 2 is an example in which one gate line group connected to one pixel PX may include three gate lines 121*i*, 121(*i*+1), and 121(*i*+2); however, the number of gate lines included in one gate line group may not be limited thereto, and may be changed according to a number of subpixels included in each pixel PX.

The storage electrode line 131 may be applied at a predetermined voltage. The storage electrode line 131 may extend to cross the gate lines 121*i*, 121(*i*+1), and 121(*i*+2). However, the storage electrode line 131 may extend parallel to the gate lines 121*i*, 121(*i*+1), and 121(*i*+2). The storage electrode line 131 may include a plurality of storage electrodes 137 at positions corresponding to each of the subpixels SPX1, SPX2, and SPX3.

The storage electrode line 131 may be formed differently from the gate lines 121*i*, 121(*i*+1), and 121(*i*+2) and in some cases, may be omitted.

A gate insulating layer 140 may be made of silicon nitride ($SiN_x$) or silicon oxide ($SiO_x$) and may be formed on the gate conductor.

A semiconductor 154 made of a semiconductor material such as amorphous silicon, polysilicon, or an oxide semiconductor, may be positioned on the gate insulating layer 140. The semiconductor 154 may include a portion positioned on the gate electrode 124 and overlapping the gate electrode 124.

A pair of ohmic contact islands 163 and 165 may be positioned on each semiconductor 154. In some cases, the ohmic contacts 163 and 165 may be made of n+ hydrogenated a-Si heavily doped with an N-type impurity such as phosphorous. In some cases, the ohmic contacts 163 and 165 may be made of a silicide. In some cases, the ohmic contacts 163 and 165 may be omitted.

A data conductor including a plurality of data lines 171 and a plurality of drain electrodes 175 may be formed on the ohmic contacts 163 and 165 and the gate insulating layer 140.

The data lines 171 may transmit a data voltage and may mainly extend in a column direction crossing the gate lines 121*i*, 121(*i*+1), 121(i+2). Each data line 171 may include a plurality of source electrodes 173 extending toward the gate electrodes 124.

The drain electrode 175 may be provided for each of the subpixels SPX1, SPX2, and SPX3. The drain electrode 175 may face the source electrode 173 with respect to the gate electrode 124 while overlapping the semiconductor 154.

The gate electrode 124, the source electrode 173, and the drain electrode 175 may form a thin film transistor (TFT) along with the semiconductor 154, and a channel of each thin film transistor may be formed in the semiconductor 154 between the source electrode 173 and the drain electrode 175.

A passivation layer 180 may be disposed on the data conductor and the exposed portion of the semiconductor 154. The passivation layer 180 may have a plurality of contact holes 185 exposing the drain electrodes 175.

A plurality of pixel electrodes 191*i*, 191(*i*+1), and 191(*i*+2) may be disposed on the passivation layer 180. The pixel electrodes 191*i*, 191(*i*+1), and 191(*i*+2) may be made of a transparent conductor such as Indium Titanium Oxide (ITO) or Indium Zinc Oxide (IZO), or a is reflective conductor such as silver, aluminum, chromium, or alloys thereof.

One of the pixel electrodes 191*i*, 191(*i*+1), and 191(*i*+2) may be positioned in each of the subpixels SPX1, SPX2, and SPX3, respectively. The pixel electrodes 191*i*, 191(*i*+1), and 191(*i*+2) of the subpixels SPX1, SPX2, and SPX3 respectively may be electrically and physically connected to the drain electrodes 175 through the contact holes 185 thereby receiving the data voltage.

The pixel electrodes 191*i*, 191(*i*+1), and 191(*i*+2) may have at least one cutout or protrusion, however the shape of the pixel electrodes 191*i*, 191(*i*+1), and 191(*i*+2) may not be limited thereto. Each of the pixel electrodes 191*i*, 191(*i*+1), and 191(*i*+2) may have a longer length in the row direction than the length of the column direction as shown in FIG. 2, however the length of the pixel electrodes 191*i*, 191(*i*+1), and 191(*i*+2) may not be limited thereto, and the length of the column direction may be longer.

Referring to the upper panel 200, an opposed electrode 270 may be positioned on an insulation substrate 210, which may be made of a transparent material, such as glass or plastic. The opposed electrode 270 may be made of a transparent conductor such as ITO and IZO, and may receive the common voltage Vcom.

In some cases (not shown), the opposed electrode 270 may be positioned on the lower panel 100.

Alignment layers (not shown) may be coated on inner surfaces of the two display panels 100 and 200.

A polarizer (not shown) may be provided on at least one outer surface of the two display panels 100 and 200.

The liquid crystal layer 3 may be interposed between the lower panel 100 and the is upper panel 200 and may include liquid crystal molecules 31 having dielectric anisotropy such that a long axis may be arranged to be vertical or perpendicular to the surface of the two display panels 100 and 200 in the absence of an electric field.

In the lower panel 100 or the upper panel 200, a light blocking member (not shown) and a color filter (not shown) may be positioned. The color filter may be elongated according to a column of the pixel electrodes 191*i*, 191(*i*+1), and 191(*i*+2). Each color filter may display one of primary colors such as red, green, or blue.

The pixel electrodes 191*i*, 191(*i*+1), and 191(*i*+2) and the opposed electrode 270 may form a liquid crystal capacitor such that the applied voltage may be maintained after the thin film transistor is turned off. Meanwhile, the drain electrode 175 or the pixel electrode (191*i*, 191(*i*+1), or 191(*i*+2) may overlap the storage electrode line 131 including the storage electrodes 137 thereby forming a storage capacitor. The storage capacitor may enhance a voltage-maintaining capacity of the liquid crystal capacitor.

A driving method of the display device shown in FIG. 1 to FIG. 3 will be described with reference to FIG. 4A, FIG. 4B, FIG. 5A, FIG. 5B, FIG. 6A, and FIG. 6B.

Figure 4A:
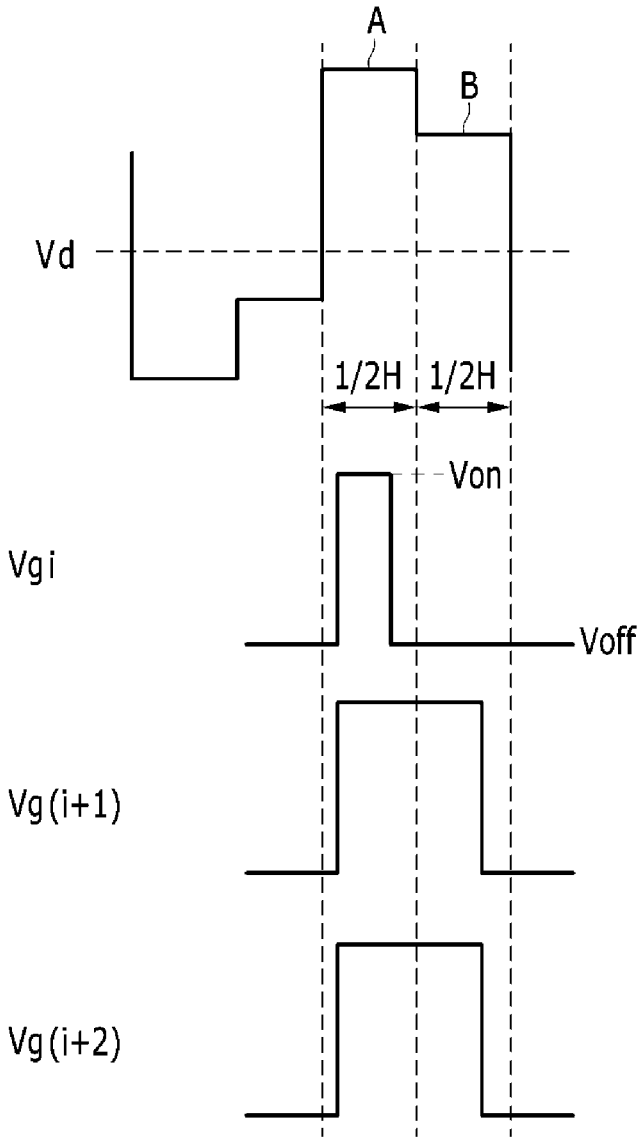
FIG. 4A is a waveform diagram of a driving signal applied to one pixel of a display device according to exemplary embodiments of the present invention.

FIG. 4A is a waveform diagram of a driving signal applied to one pixel PX of a display device.

Figure 4B:
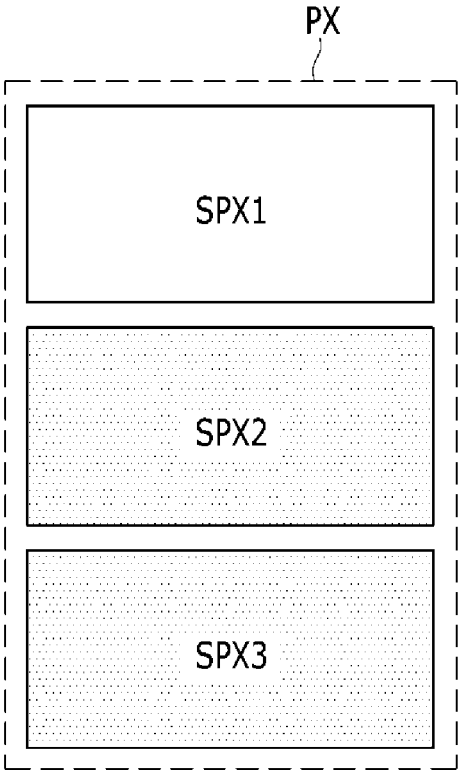
FIG. 4B is a view of a luminance of a subpixel of one pixel according to the driving method of FIG. 4A.

FIG. 4B is a view of a luminance of a subpixel SPX1, SPX2 and SPX3 of one pixel PX according to the driving method shown in FIG. 4A.

Figure 5A:
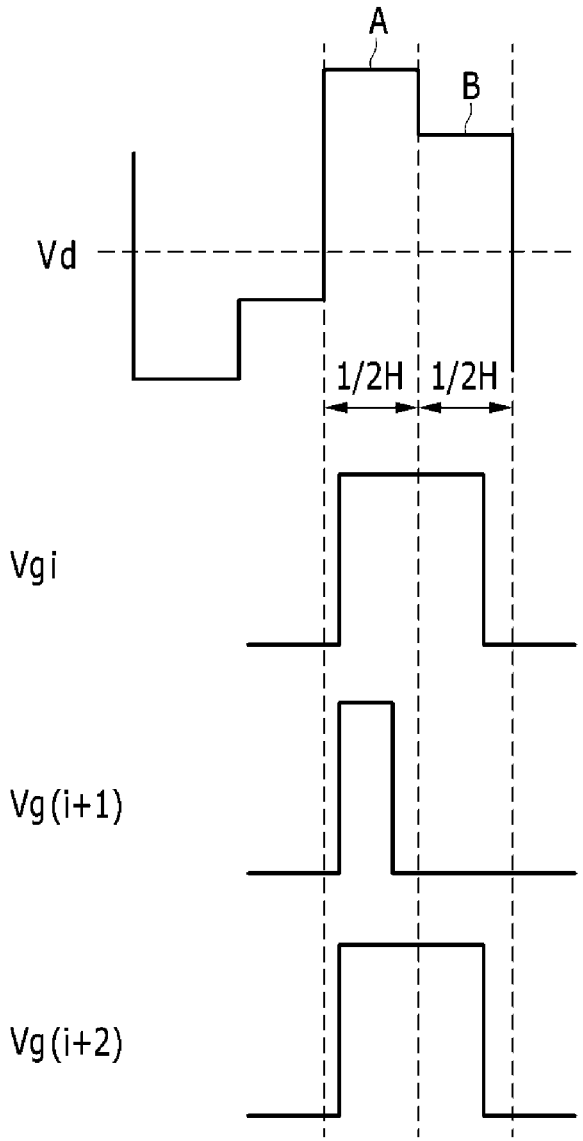
FIG. 5A is a waveform diagram of a driving signal applied to one pixel of a display device according to exemplary embodiments of the present invention.

FIG. 5A is a waveform diagram of a driving signal applied to one pixel PX of a display device.

Figure 5B:
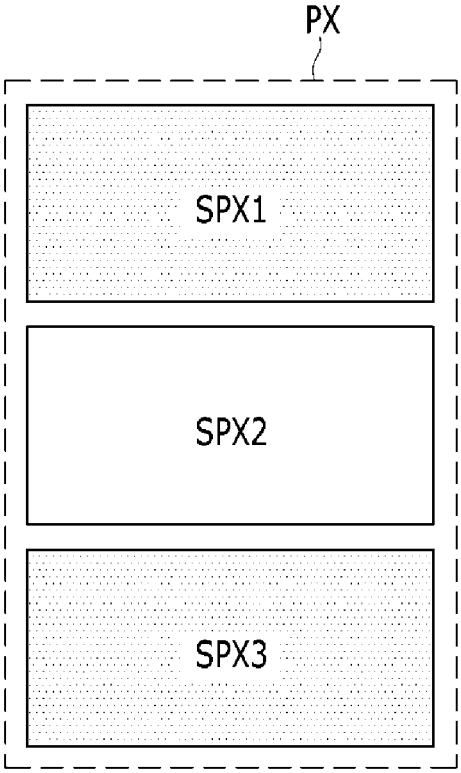
FIG. 5B is a view of a luminance of a subpixel of one pixel according to the driving method shown of FIG. 5A.

FIG. 5B is a view of a luminance of a subpixel of one pixel PX according to the driving method shown in FIG. 5A.

Figure 6A:
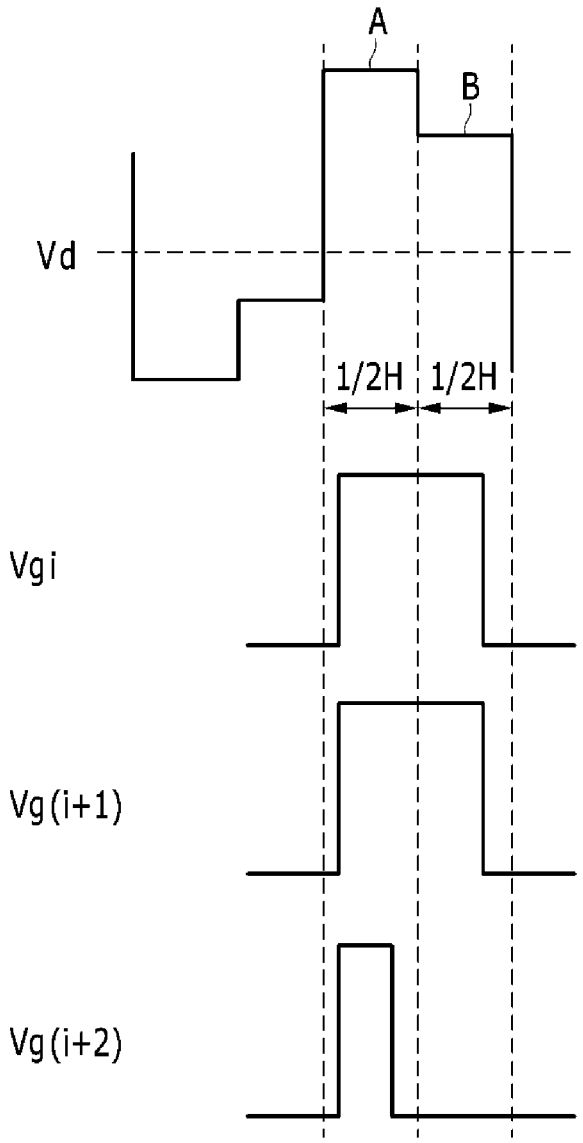
FIG. 6A is a waveform diagram of a driving signal applied to one pixel of a display device according to exemplary embodiments of the present invention.

FIG. 6A is a waveform diagram of a driving signal applied to one pixel PX of a display device.

Figure 6B:
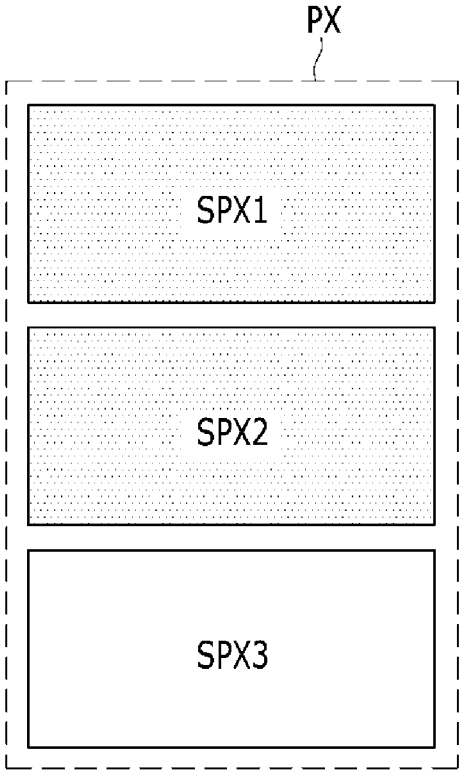
FIG. 6B is a view of a luminance of a subpixel of one pixel according to the driving method shown of FIG. 6A.

FIG. 6B is a view of a luminance of a subpixel of one pixel PX according to the driving method shown in FIG. 6A.

The following description is provided for an example in which two types of gammas curve are provided for one pixel PX including three subpixels SPX1, SPX2, and SPX3.

Referring to FIG. 4A, FIG. 5A, and FIG. 6A, the data voltage Vd applied to each data line 171 may include the data voltages according to the different gamma curves during one horizontal period 1H.

The data voltage Vd for one input image signal IDAT may include a first data voltage A and a second data voltage B according to the different gamma curves. An absolute value of the difference between the first data voltage A and the common voltage Vcom may be larger than an absolute value of the difference between the second data voltage B and the common voltage Vcom for the same gray level. When two gamma curves are used, the first data voltage A and the second data voltage B for one input image signal IDAT may be applied to the data line 171 during about half a horizontal period H.

As described above, the polarity of the data voltage Vd may be inverted for each frame or may be inverted for 1 horizontal period 1H.

The gate signals Vgi, Vg(i+1), and Vg(i+2) applied to the gate lines 121*i*, 121(*i*+1), and 121(*i*+2) included in one gate line group GS1-GSn may include the first gate signal and the second gate signal of the different waveforms. The first gate signal and the second gate signal may be applied to gate lines 121*i*, 121(*i*+1), and 121(*i*+2) among one gate line group GS1-GSn. The gate signals may be changed for a predetermined time, and may be repeatedly applied for a predetermined time (T). For example, the first gate signal and the second gate signal may be applied for a predetermined time to the gate lines 121*i*, 121(*i*+1), and 121(*i*+2) included in one gate line group GS1-GSn. In some cases, the period of the predetermined time (T) may be periodically changed, and in some cases, the period of the predetermined time (T) may stay the same.

Referring to FIG. 4A and FIG. 4B, the gate-on voltage Von may be applied to the first gate line 121*i* of one gate line group GS1-GSn during about half of 1 horizontal period 1H according to the gate line selection signal GSEL of the signal controller 600, and the gate-off voltage Voff may be applied during the remaining time of the horizontal period 1H. The gate signal of this waveform may be referred to as the first gate signal. Accordingly, the first data voltage A may be applied to the first subpixel SPX1 connected to the first gate line 121*i* and may be maintained during the rest of the frame.

In some cases, the gate-on voltage Von may be applied, during the corresponding 1 horizontal period of 1H, to the remaining gate lines 121(*i*+1) and 121(*i*+2) of gate line group GS1-GSn. The gate signal of this waveform may be referred to as the second gate signal. In some cases, the gate-on voltage Von may be applied during about ½H of the rest of corresponding 1 horizontal period of 1H, to the remaining gate lines 121(*i*+1) and 121(*i*+2) of gate line group GS1-GSn. Accordingly, the second data voltage B may be applied to the second and third subpixels SPX2 and SPX3 connected to the gate lines 121(*i*+1) and 121(*i*+2) and may be maintained during the rest of the frame. The first data voltage applied to the second and third subpixels SPX2 and SPX3 during about half of 1 horizontal period 1H may function as a linear charging voltage of the second and third subpixels SPX2 and SPX3.

After the corresponding 1 horizontal period 1H, the first data voltage A may be is applied to the first subpixel SPX1 and the second data voltage B may be applied to the second and third subpixels SPX2 and SPX3, as shown in FIG. 4B. The luminance of image displayed in first subpixel SPX1 may be higher than the luminance of the image displayed in the second and third subpixels SPX2 and SPX3 respectively. The lateral gamma curve may be close to the front gamma curve by controlling the different luminance of the images displayed by the subpixels SPX1, SPX2, and SPX3 of one pixel PX so that the lateral visibility may be improved. If the area of the subpixel SPX1 representing the high luminance is smaller than the area of the subpixels SPX2 and SPX3 representing the low luminance, the lateral visibility may be further improved. When the ratio of the area of subpixel SPX1, representing the high luminance, and the area of the subpixels SPX2 and SPX3 representing the low luminance is about 1:2, the lateral visibility may be further improved.

Referring to FIG. 5A and FIG. 5B, according to the gate line selection signal GSEL of the signal controller 600, the gate-on voltage Von may be applied to the second gate line 121(*i*+1) of gate line group GS1-GSn during the former about ½H of 1 horizontal period of 1H. The gate-off voltage Voff may be applied during the latter about ½H of 1 horizontal period of 1H. Accordingly, the first data voltage A may be applied to the second subpixel SPX2 connected to the gate line 121(*i*+1), and may be maintained during the rest of the frame.

The second gate signal of which the gate-on voltage Von may be applied to the remaining gate lines 121*i* and 121(*i*+2) of the group GS1-GSn during the corresponding 1 horizontal period 1H. The gate-on voltage Von may be applied during the latter about ½H of the 1 horizontal period 1H. Accordingly, the second data voltage B may be applied to the first and third subpixels SPX1 and SPX3 connected to the gate lines 121*i* and 121(*i*+2) and may be maintained during the rest of the frame.

As shown in FIG. 5B, the luminance of the image displayed by the second subpixel SPX2 may be higher than the luminance of the image displayed by the first and third subpixels SPX1 and SPX3. The lateral visibility may be improved.

Referring to FIG. 6A and FIG. 6B, according to the gate line selection signal GSEL of the signal controller 600, the first gate signal of the gate-on voltage Von may be applied to the second gate line 121(*i*+2) of one gate line group GS1-GSn during the former about ½H of 1 horizontal period 1H. The gate-off voltage Voff may be applied during the latter about ½H of 1 horizontal period 1H. Accordingly, the first data voltage A may be applied to the third subpixel SPX3 connected to the gate line 121(*i*+2) and may be maintained during the rest of the frame.

The second gate signal of the gate-on voltage Von may be applied to the remaining gate lines 121*i* and 121(*i*+1) of the gate line group GS1-GSn during the 1 horizontal period 1H.

The gate-on voltage Von may be applied during the latter about ½H of the corresponding 1 horizontal period 1H. Accordingly, the second data voltage B may be applied to the first and second subpixels SPX1 and SPX2 connected to the gate lines 121*i* and 121(*i*+1) and may be maintained during the rest of the frame.

As shown in FIG. 6B, the luminance of image displayed by the third subpixel SPX3 may be higher than the luminance of the image displayed by the first and second subpixels SPX1 and SPX2. The lateral visibility may be improved.

The sequence of three driving patterns shown in FIG. 4A, FIG. 4B, FIG. 5A, FIG. 5B, FIG. 6A, and FIG. 6B may be changed, and driving patterns may be repeated with the period of the predetermined time (T). The gate line selection signal GSEL may be controlled to repeat three driving patterns with the period of the predetermined time (T).

The first gate signal and the second gate signal shown in FIG. 4A to FIG. 6B may be generated in synchronization with the different gate clock signals or the different gate signals having the pulse widths.

One subpixel of SPX1, SPX2, and SPX3 may be applied with the data voltage (Vd) according to a different gamma curve (e.g., about ⅓T) of the predetermined time (T) such that a DC bias generated by collection of the charges into one of the display panels 100 and 200 may be reduced even though the image of the same pattern is displayed for a long time. Accordingly, the afterimage by the DC bias may be decreased.

A driving method of a display device will be described with reference to FIG. 7, FIG. 8 and FIG. 9.

Figure 7:
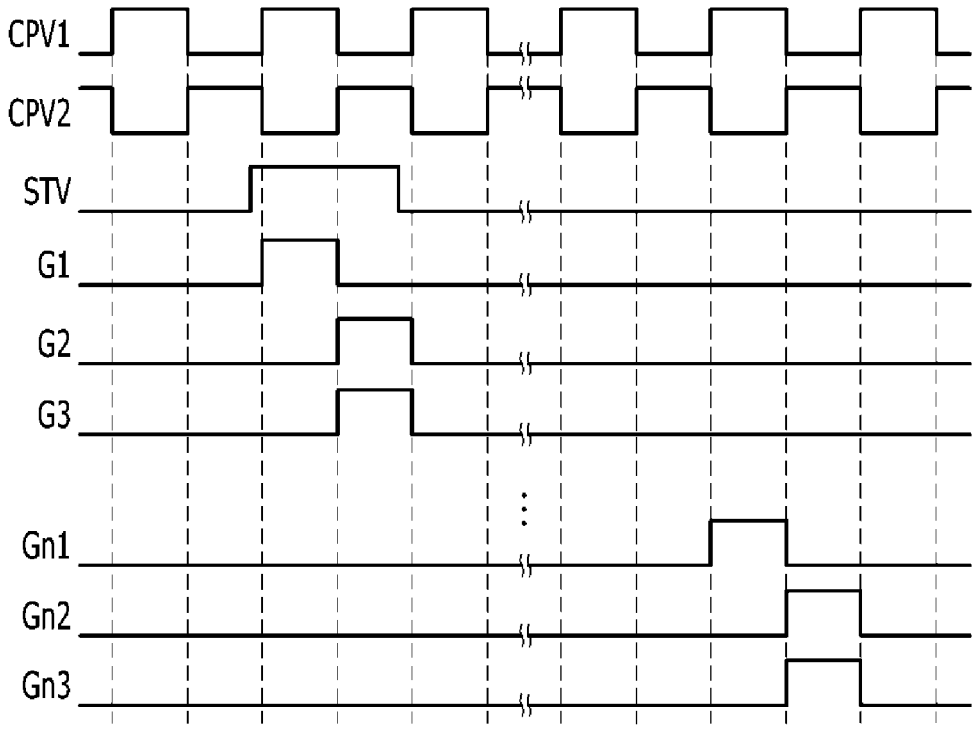
FIG. 7, FIG. 8, and FIG. 9 show examples of a waveform diagram of a driving signal of a display device according to exemplary embodiments of the present invention.
Figure 8:
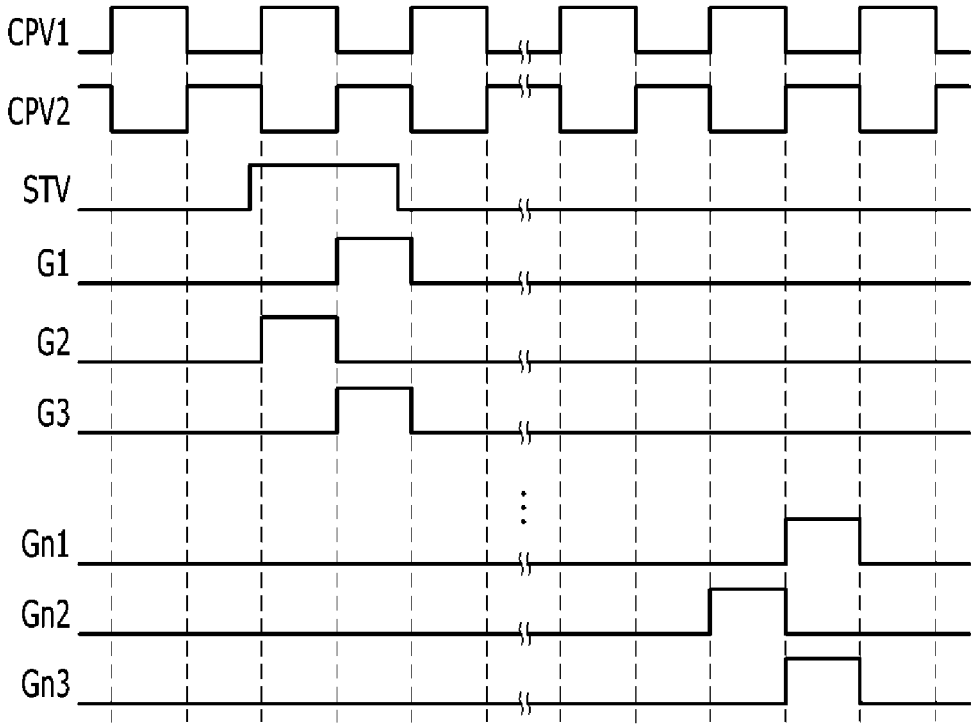
Figure 9:
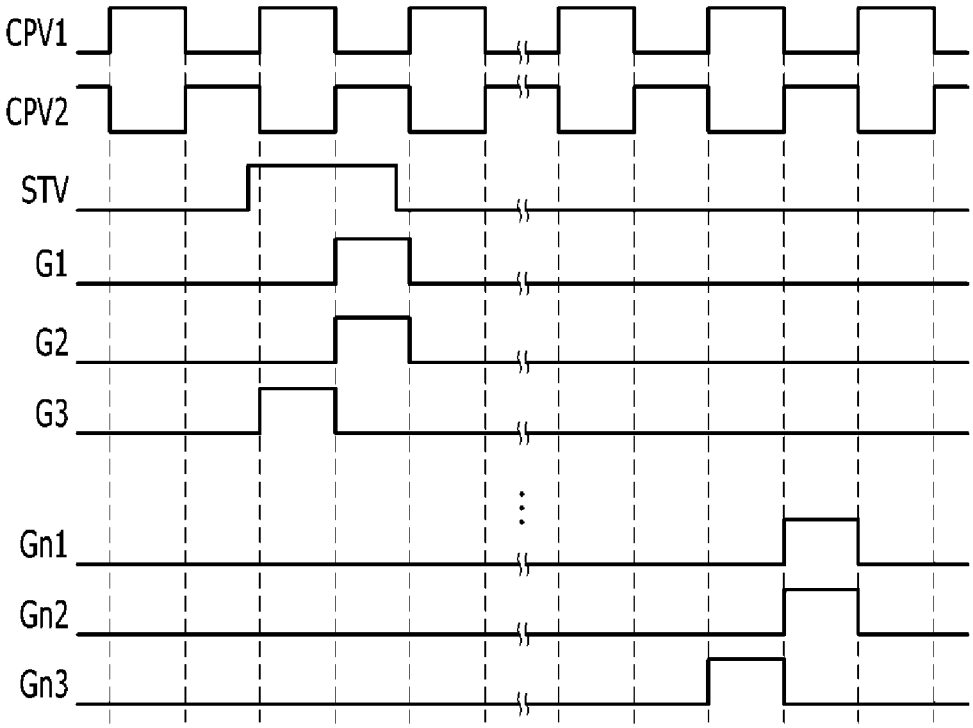

FIG. 7, FIG. 8, and FIG. 9 are examples of a waveform diagram of a driving signal of a display device.

The driving method of the display device has the same effect as the driving method of the display device according to the above-described exemplary embodiments and only differences will be described.

Referring to FIG. 7, FIG. 8 and FIG. 9, a gate control signal CONT1 may include the first and second gate clock signals CPV1 and CPV2 which may be different from each other. The first and second gate clock signals CPV1 and CPV2 may have inverted phases, and the duty ratios may respectively be 50%. The width of the pulse of the first and second gate clock signals CPV1 and CPV2 may be about half a horizontal period (½H).

Referring to FIG. 7, the first driving pattern will be described. If one frame is started according to the application of the scanning start signal STV, the gate-on voltage Von may be applied to the first gate lines G1 . . . Gn1 of gate line group GS1-GSn. The gate-on is voltage Von may be synchronized with a time that the voltage level of the first gate clock signal CPV1 is changed from the low to the high. The gate-on voltage Von may be applied to the second gate lines G2 . . . Gn2 and the third gate lines G3 . . . Gn3 of the gate line groups GS1-GSn in synchronization with the second gate clock signal CPV2. The gate-on voltage Von may be applied during about ½H and the pulse width of the gate-on voltage Von may be the same.

When the gate-on voltage Von is applied to the first gate lines G1 . . . Gn1 of gate line group GS1-GSn, the data line D1-Dm connected to the corresponding pixel PX may be applied with the data voltage (Vd) according to the gamma curve of the high luminance. When the second gate lines G2 . . . Gn2 and the third gate lines G3, . . . Gn3 are applied with the gate-on voltage Von, the data line D1-Dm connected to the corresponding pixel PX may be applied with the data voltage (Vd) according to the gamma curve of the low luminance.

Referring to FIG. 8, if one frame is started according to the application of the scanning start signal STV, the second gate lines G2 . . . Gn2 of gate line group GS1-GSn may be applied with the gate-on voltage Von in synchronization with the first gate clock signal CPV1. The first gate lines G1 . . . Gn1 and the third gate lines G3 . . . Gn3 of gate line group GS1-GSn may be applied with the gate-on voltage Von in synchronization with the second gate clock signal CPV2. The gate-on voltages Von may be applied during about ½H and the pulse width of the gate-on voltage Von may be the same.

When the gate-on voltage Von is applied to the second gate lines G2 . . . Gn2 of gate line group GS1-GSn, the data line D1-Dm connected to the corresponding pixel PX may be applied with the data voltage (Vd) according to the gamma curve of the high luminance. When the first gate lines G1 . . . Gn1 and the third gate lines G3, . . . Gn3 are applied with the gate-on voltage Von, the data lines D1-Dm connected to the corresponding pixel PX may be applied with is the data voltage (Vd) according to the gamma curve of the low luminance.

Referring to FIG. 9 if one frame is started according to the application of the scanning start signal STV, the third gate lines G3 . . . Gn3 of gate line group GS1-GSn may be applied with the gate-on voltage Von in synchronization with the first gate clock signal CPV1. The first gate lines G1 . . . Gn1 and the second gate lines G2 . . . Gn2 of gate line group GS1-GSn may be applied with the gate-on voltage Von in synchronization with the second gate clock signal CPV2. The gate-on voltages Von may be applied during about ½H and the pulse width of the gate-on voltage Von may be the same.

When the gate-on voltage Von is applied to the third gate lines G3 . . . Gn3 of gate line groups GS1-GSn, the data lines D1-Dm connected to the corresponding pixel PX may be applied with the data voltage (Vd) according to the gamma curve of the high luminance. When the first gate lines G1 . . . Gn1 and the second gate lines G2 . . . Gn2 are applied with the gate-on voltage Von, the data lines D1-Dm connected to the corresponding pixel PX may be applied with the data voltage (Vd) according to the gamma curve of the low luminance.

As described above, three driving patterns shown in FIG. 7, FIG. 8 and FIG. 9 may be repeated with the period of the predetermined time (T). The sequence of the different driving patterns included in one period may be changed, and the number of subpixels SPX1, SPX2, and SPX3 included in one pixel PX and the number of driving patterns may not be limited to the description of the present exemplary embodiment.

A driving method of a display device will be described with reference to FIG. 10, FIG. 11, FIG. 12, FIG. 12 and FIG. 14.

Figure 10:
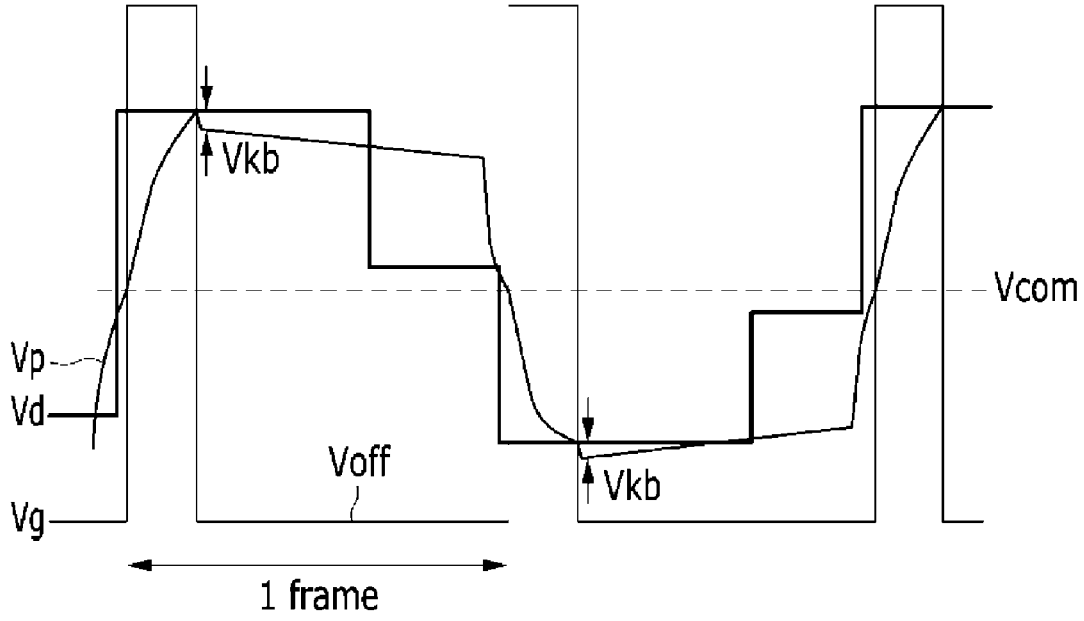
FIG. 10 shows an example of a waveform diagram of a driving signal of a display device according to exemplary embodiments of the present invention.

FIG. 10 is an example of a waveform diagram of a driving signal of a display device.

Figure 11:
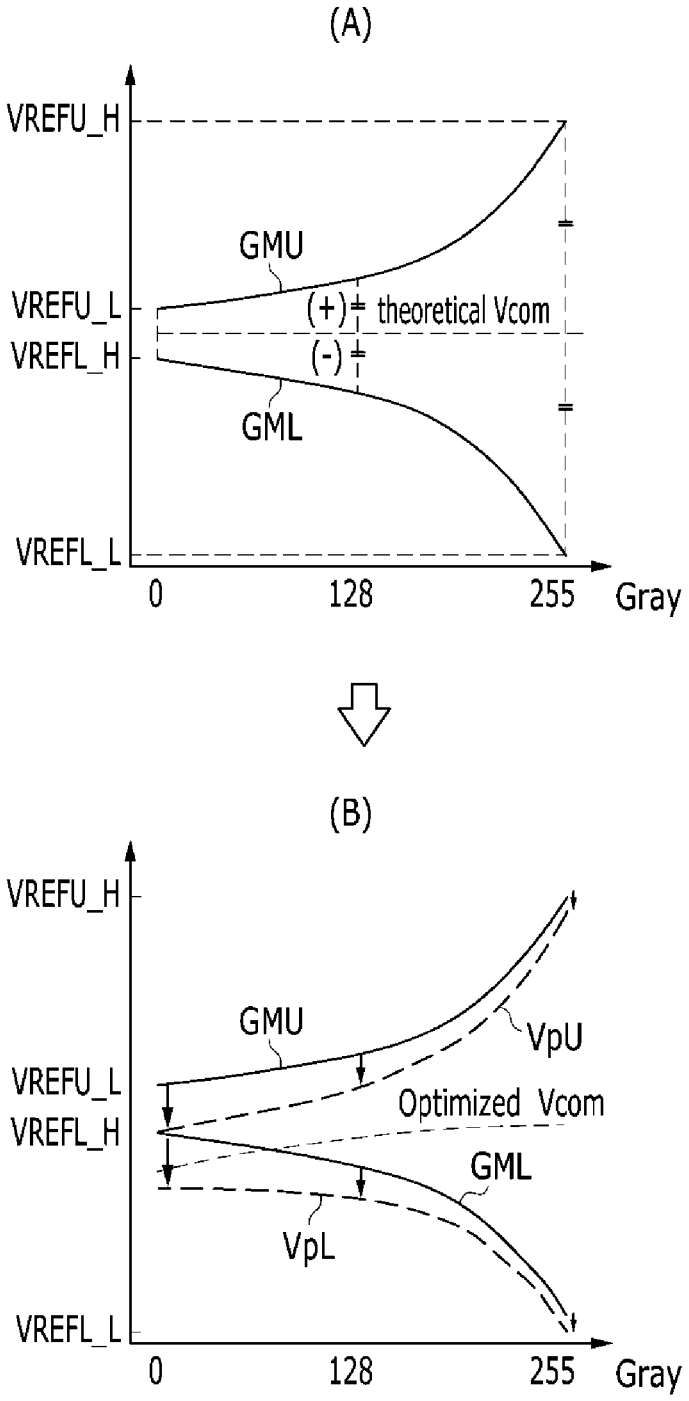
FIG. 11, FIG. 12, and FIG. 13 are graphs of gray voltage and pixel voltage of a display device according to exemplary embodiments of the present invention.
Figure 12:
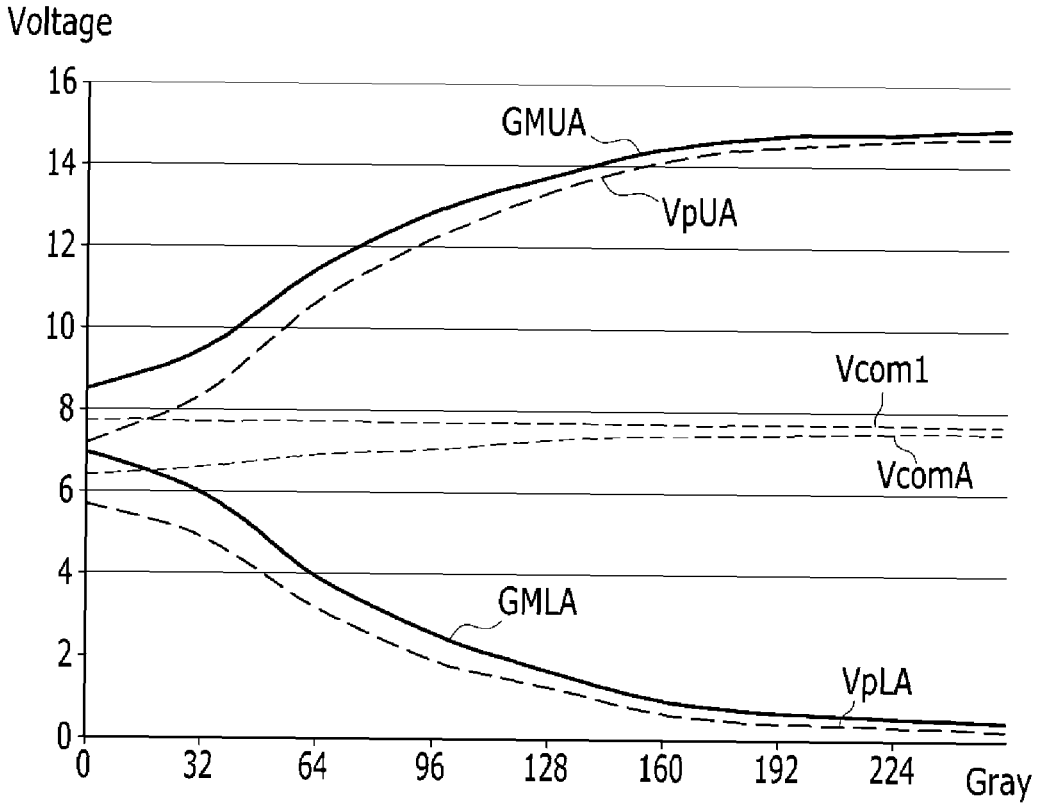
Figure 13:
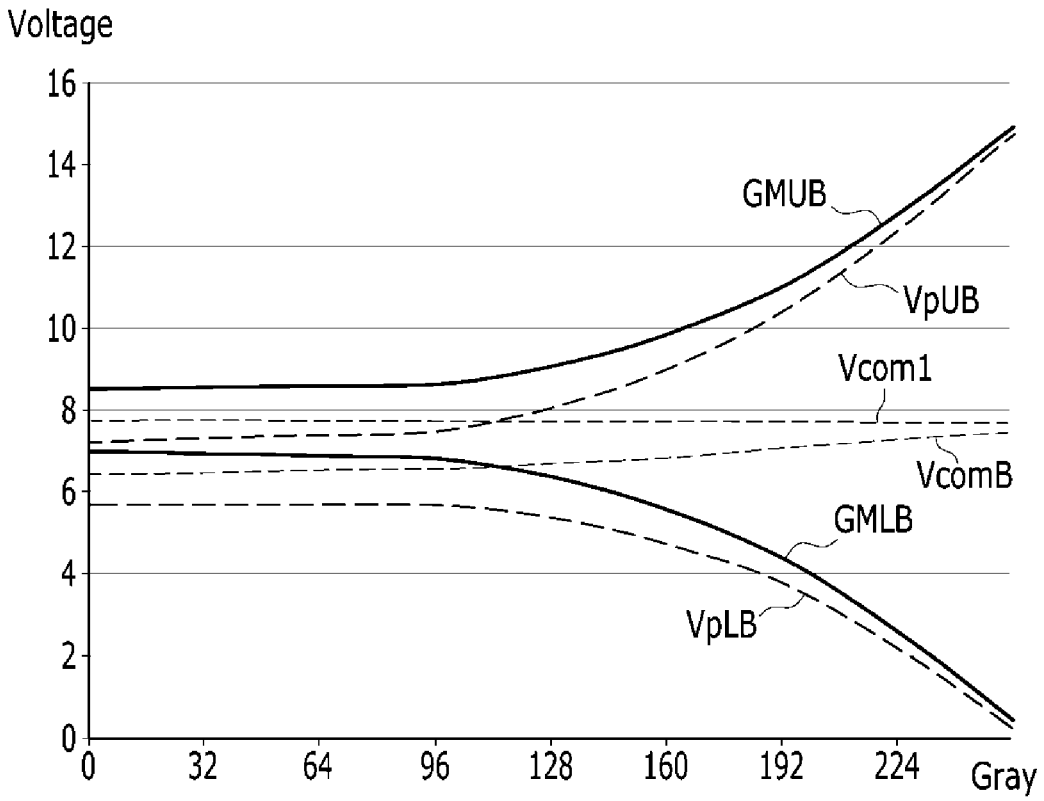

FIG. 11, FIG. 12, and FIG. 13 are graphs of gray voltages and pixel voltages of a display device.

Figure 14:
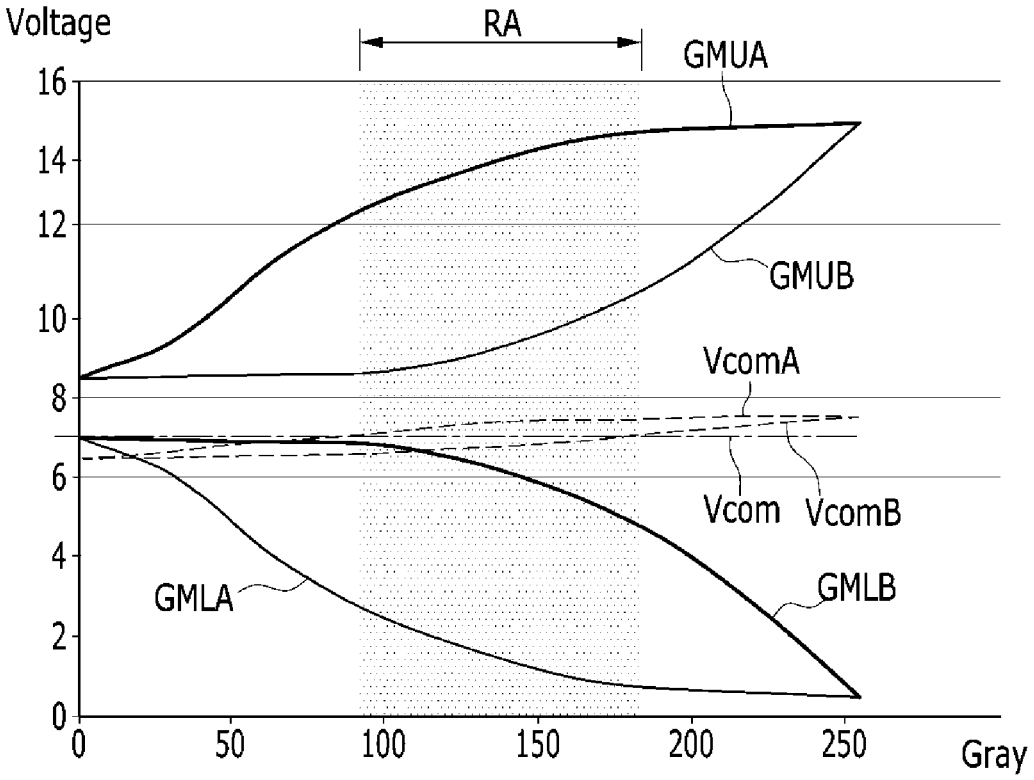
FIG. 14 is a graph of a gray voltage and an optimized common voltage of a display device according to exemplary embodiments of the present invention.

FIG. 14 is a graph of a gray voltage and an optimized common voltage of a display device.

Referring to FIG. 10, when the data voltage Vd is applied to the data lines D1-Dm connected to subpixel SPX1-SPXk and the level of the gate signal Vg applied to the gate lines G1-Gnk is the gate-on voltage Von, the pixel voltage Vp charged to subpixels SPX1-SPXk may be changed to the target data voltage (Vd). If the gate signal Vg is dropped to the gate-off voltage Voff, the pixel voltage Vp may be dropped by the kick-back voltage Vkb by parasitic capacitance between the pixel electrodes 191*i*, 191(*i*+1), and 191(*i*+2). The drain electrode 175 and the gate lines 121*i*, 121(*i*+1), and 121(*i*+2) and the changed pixel voltage Vp may be approximately maintained during the rest of the frame. The magnitude of the kickback voltage (Vkb) may be different for each gray voltage. In case of the liquid crystal display of the vertical alignment (VA) mode, when luminance becomes the low gray, the kickback voltage may be increased.

Referring to FIG. 11 A, a theoretical common voltage Vcom applied to the opposed electrode 270 may be uniform according to the gray voltage when a curved line GMU of a positive gray voltage and a curved line GML of a negative gray voltage are symmetrical.

However, the curved lines VpU and VpL of the pixel voltages that are charged to the subpixels SPX1-SPXk for each gray voltage may be lower than the curved lines GMU and GML of the gray voltage shown in FIG. 11 B by the influence of the kickback voltage. When the kickback voltage for each gray voltage is different, the curved lines VpU and VpL of the pixel voltage may be asymmetrical to each other, and the optimized common voltage Vcom may be changed according to the gray voltage.

Referring to FIG. 12 and FIG. 13, the optimized common voltage Vcom of the image displayed by the display device may depend on the first gray voltage curved lines GMUA and GMLA. The second gray voltage curved lines GMUB and GMLB will be described.

Referring to FIG. 12, when the image displayed by the subpixels SPX1-SPXk depends on the positive first gray voltage curved line GMUA, the pixel voltage curved line VpUA may be lower than the positive first gray voltage curved line GMUA by the influence of the kickback voltage. When the image displayed by the subpixels SPX1-SPXk depends on the negative first gray voltage curved line GMLA, the pixel voltage curved line VpLA may be lower than the negative first gray voltage curved line GMLA by the influence of the kickback voltage. Accordingly, the optimized common voltage Vcom may not be the theoretical common voltage Vcoml, but may be the first common voltage VcomA. The value of first common voltage VcomA may be changed according to the gray voltage.

Referring to FIG. 13, when the image displayed by the subpixels SPX1-SPXk depends on the positive second gray voltage curved line GMUB, the pixel voltage curved line VpUB may be lower than the positive second gray voltage curved line GMUB by the influence of the kickback voltage. When the image displayed by the subpixels SPX1-SPXk depends on the negative second gray voltage curved line GMLB, the pixel voltage curved line VpLB may be lower than the negative second gray voltage curved line GMLB by the influence of the kickback voltage. Accordingly, the optimized common voltage Vcom may not be the theoretical common voltage Vcoml. The second common voltage VcomB, and the value of the second common voltage VcomB may be changed according to the gray voltage.

Referring to FIG. 14 in which the first and second gray voltage curved lines GMUA and GMUB, and GMLA and GMLB, and the first and second common voltages VcomA and VcomB, shown together in FIG. 12 and FIG. 13, the optimized common voltages VcomA and VcomB, depending on the first gray voltage curved lines GMUA and GMLA, and the second gray voltage curved lines GMUB and GMLB may be different according to the gray voltage.

If the common voltage Vcom applied to the opposed electrode 270 is set as a predetermined common voltage Vcom according to the gray voltage, a polarity inversion region (RA) may be generated. The first common voltage (VcomA) of the optimized common voltage for the first gray voltage curved lines GMUA and GMLA may be larger than the common voltage Vcom in the polarity inversion region (RA). Also, the second common voltage (VcomB) of the common voltage for the second gray voltage curved lines GMUB and GMLB may be smaller than the common voltage Vcom in the polarity inversion region (RA).

If only one gamma curve is applied in the polarity inversion region (RA) like the first gray voltage curved lines GMUA and GMLA or the second gray voltage curved lines GMUB and GMLB, the charges may gather on one side of the pixel electrode (191*i* to 191(*i*+2)) or the opposed electrode 270, thereby generating the DC bias. However, if the gamma curve for the image applied to the subpixels SPX1-SPXk is changed with the period of the predetermined time (T), the polarity of the DC bias is periodically changed such that the afterimages may be decreased.

The gray voltage in a lowest gray (0 gray) and a highest gray (e.g., 256 gray) of the first gray voltage curved lines GMUA and GMLA and the second gray voltage curved lines GMUB and GMLB may be different. The first common voltage VcomA and the second common voltage VcomB may have the different values through the entire gray voltages, and the gray voltage range included in the polarity inversion region (RA) may be widened. Accordingly, the gray voltage range of which the afterimage is decreased may be widened.

FIG. 15A is a table of experimental data to confirm an afterimage degree of a display device.

Figure 15B:
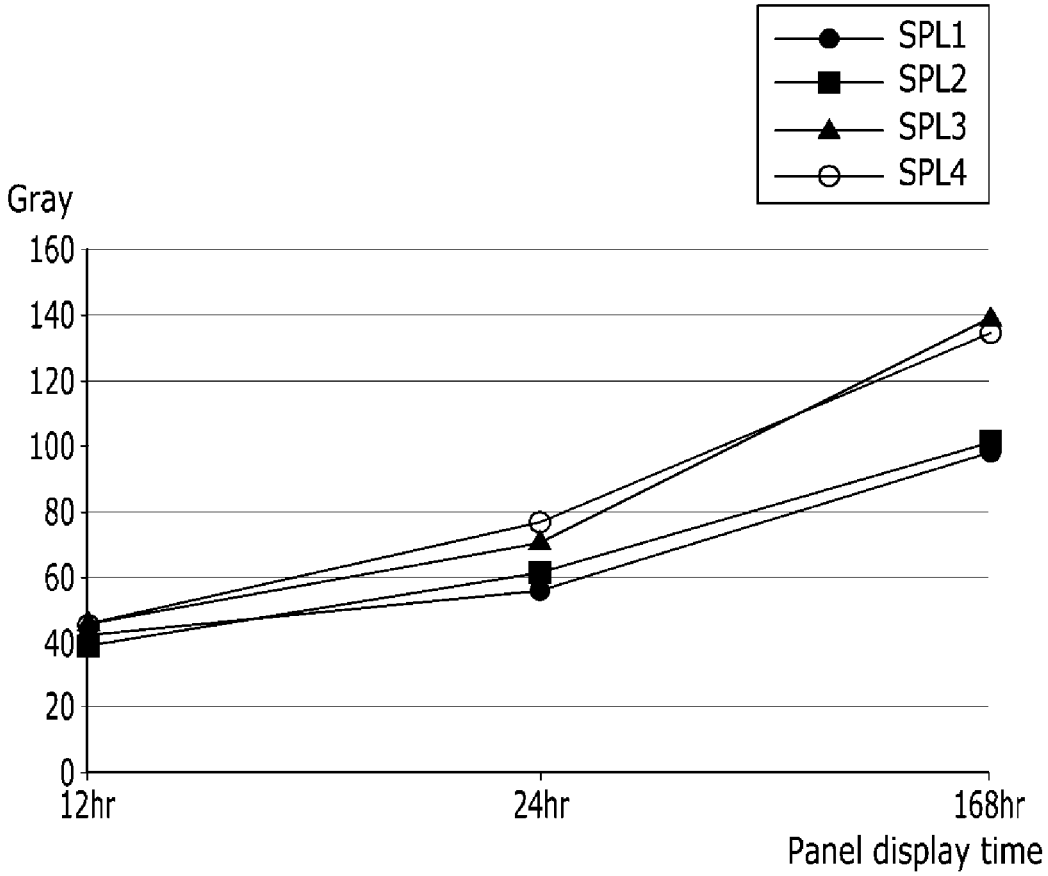
FIG. 15B is a graph of the experimental data of FIG. 15A.

FIG. 15B is a graph of the experimental data of FIG. 15A.

While the image of predetermined pattern may be displayed 12 times, 24 times, and 168 times at a temperature of about 50° C., and then the gray of the image displayed on the entire screen may gradually change from the lowest gray to the highest gray, the gray at which the afterimage starts to disappear may be confirmed and a degree of afterimage may be measured. The predetermined time (T) of the period that is swung between the first data voltage A and the second data voltage B may be about 60 minutes.

When the subpixels SPX1-SPXk are alternately applied with the first data voltage A and the second data voltage B according to the different gamma curves with the period of about 60 minutes, the gray voltage at which the afterimage starts to disappear may be decreased compared with conventional art. As the display time of the predetermined pattern is very long, like e.g., at 168 times, the gray voltage at which the afterimage starts to disappear may further be decreased by 30 to 40 gray voltages compared with conventional art, and the afterimage effect may be further decreased.

While this invention has been described in connection with what is presently considered to be practical exemplary embodiments, it is to be understood that the invention is not limited to the disclosed exemplary embodiments, but, on the contrary, is intended to cover various modifications and equivalent arrangements included within the spirit and scope of the appended claims.

What is claimed is:

1. A method of driving a display device, comprising:

receiving an image signal;

converting the image signal into at least two data voltages according to at least two gamma curves;

applying, during a frame, a first gate signal to a first gate line among a plurality of gate lines respectively connected to a plurality of subpixels in a pixel and a second gate signal to a remaining plurality of gate lines of the plurality of gate lines respectively connected to the plurality of subpixels in the pixel; and applying the at least two data voltages to the plurality of subpixels during the frame, wherein selection of the first gate signal and the second gate signal to be applied is controlled by a gate line selection signal, wherein gamma curves for the data voltage applied to one subpixel among the plurality of subpixels comprise the at least two gamma curves and the gamma curves for the data voltage are changed with a period of a first time, and wherein the first gate signal and the second gate signal include a gate on voltage and a gate off voltage, and a waveform of the first gate signal is different from a waveform of the second gate signal.

2. The method of claim 1, further comprising:

applying gate signals comprising the first gate signal and the second gate signal to one gate line of the plurality of gate lines, the first gate signal and the second gate signal being applied in different frames, and changing the gate signals applied to the one gate line according to the period of the first time.

3. The method of claim 2, further comprising:

applying a data voltage to the one subpixel connected to the first gate line according to a first gamma curve in response to the first gate signal being applied to the first gate line among the plurality of gate lines; and applying a data voltage to at least two subpixels connected to at least two second gate lines among the plurality of gate lines according to a second gamma curve that is different from the first gamma curve in response to the second gate signal being applied to the at least two second gate lines.

4. The method of claim 3, wherein a pulse width of the first gate signal is smaller than a pulse width of the second gate signal.

5. The method of claim 4, wherein a pulse of the second gate signal partially overlaps a pulse of the first gate signal.

6. The method of claim 5, wherein the pulse width of the first gate signal is about ½ horizontal period, and the pulse width of the second gate signal is about 1 horizontal period.

7. The method of claim 6, further comprising:

sequentially applying the first gate signal to the plurality of gate lines arranged sequentially in a first direction.

8. The method of claim 3, wherein a pulse width of the first gate signal and a pulse width of the second gate signal are substantially the same.

9. The method of claim 8, further comprising:

synchronizing the first gate signal with a first gate clock signal; and synchronizing the second gate signal with a second gate clock signal, and wherein the first gate clock signal and the second gate clock signal have inverted phases.

10. The method of claim 9, wherein the pulse width of the first gate signal and the pulse width of the second gate signal are about ½ horizontal period.

11. The method of claim 10, further comprising:

sequentially applying the first gate signal to the plurality of gate lines arranged sequentially in a first direction.

12. The method of claim 2, wherein a pulse width of the first gate signal is smaller than a pulse width of the second gate signal.

13. The method of claim 2, wherein a pulse of the second gate signal partially overlaps a pulse of the first gate signal.

14. The method of claim 2, wherein the pulse width of the first gate signal is about ½ horizontal period, and the pulse width of the second gate signal is about 1 horizontal period.

15. The method of claim 2, further comprising:

sequentially applying the first gate signal to the plurality of gates lines arranged sequentially in a first direction.

16. The method of claim 2, wherein a pulse width of the first gate signal and a pulse width of the second gate signal are substantially the same.

17. The method of claim 2, further comprising:

synchronizing the first gate signal with a first gate clock signal; and synchronizing the second gate signal with a second gate clock signal, and wherein the first gate clock signal and the second gate clock signal have inverted phases.

18. The method of claim 2, wherein the pulse width of the first gate signal and the pulse width of the second gate signal are about ½ horizontal period.

19. A display device, comprising:

a pixel comprising a plurality of subpixels;

a gate line group comprising a plurality of gate lines connected to the plurality of subpixels; and a data line connected to the plurality of subpixels, wherein at least two data voltages according to different gamma curves are applied to the plurality of subpixels during a frame, wherein gamma curves for the data voltage applied to one subpixel among the plurality of subpixels comprise the at least two gamma curves and the gamma curves for the data voltage are changed with a period of a first time, wherein gate signals applied to one gate line of the plurality of gate lines comprise a first gate signal and a second gate signal applied in different frames as determined based upon a gate line selection signal, and the gate signals applied to the one gate line are changed with the period of the first time, and wherein the first gate signal and the second gate signal include a gate on voltage and a gate off voltage, and a waveform of the first gate signal is different from a waveform of the second gate signal.

20. A method of driving a display device comprising a pixel comprising a plurality of subpixels respectively connected to a plurality of gate lines, the method comprising:

receiving a first frame of an image signal;

applying a first gate signal to a first gate line among the plurality of gate lines for a first portion of one horizontal period of the first frame, the first gate line being connected to a first subpixel of the plurality of subpixels;

applying a second gate signal to a second gate line among the plurality of gate lines for a second portion of the one horizontal period of the first frame different from the first portion of the one horizontal period, the second gate line being connected to a second subpixel of the plurality of subpixels;

applying the second gate signal to a third gate line among the plurality of gate lines for the second portion of the one horizontal period of the first frame, the third gate line being connected to a third subpixel of the plurality of subpixels;

applying a first data signal to the first subpixel during the first portion of the one horizontal period of the frame, the first data signal being determined according to a first gamma curve; and applying a second data signal to the second subpixel and the third subpixel during the second portion of the one horizontal period of the frame, the second data signal being determined according to a second gamma curve different from the first gamma curve.

21. The method of claim 20, further comprising:

applying the second gate signal to the second gate line for the first portion of the one horizontal period of the first frame;

applying the second gate signal to the third gate line for the first portion of the one horizontal period of the first frame;

applying the first data signal to the second subpixel and the third subpixel during the first portion of the one horizontal period of the frame.

* * * * *